United States Patent [19]

Shimada et al.

[11] 4,322,584

[45] Mar. 30, 1982

[54] VOICE COIL BOBBIN FOR PLANAR DIAPHRAGM

[75] Inventors: Kunihiko Shimada; Yukio Tsuchiya, both of Tokorozawa, Japan

[73] Assignee: Pioneer Electronic Corporation, Tokyo, Japan

[21] Appl. No.: 164,129

[22] Filed: Jun. 30, 1980

[30] Foreign Application Priority Data

| | | | |
|---|---|---|---|
| Jun. 30, 1979 | [JP] | Japan | 54/90261[U] |
| Jun. 30, 1979 | [JP] | Japan | 54/90262[U] |
| Jun. 30, 1979 | [JP] | Japan | 54/90265[U] |
| Jun. 30, 1979 | [JP] | Japan | 54/90273[U] |
| Jun. 30, 1979 | [JP] | Japan | 54/90274[U] |

[51] Int. Cl.[3] ..... H04R 9/04

[52] U.S. Cl. ..... 179/115.5 VC

[58] Field of Search ..... 179/115.5 R, 115.5 VC

[56] References Cited

U.S. PATENT DOCUMENTS

| | | | |
|---|---|---|---|
| 1,952,357 | 3/1934 | Blumlein et al. | 179/115.5 R |
| 2,261,110 | 11/1941 | Engholm | 179/115.5 R |
| 3,513,270 | 5/1970 | Warning | 179/115.5 VC |

FOREIGN PATENT DOCUMENTS

| | | | |
|---|---|---|---|
| 640853 | 12/1936 | Fed. Rep. of Germany | 179/115.5 VC |
| 1174364 | 7/1964 | Fed. Rep. of Germany | 179/115.5 VC |
| 465830 | 5/1937 | United Kingdom | 179/115.5 VC |

*Primary Examiner*—George G. Stellar

*Attorney, Agent, or Firm*—Sughrue, Mion, Zinn, Macpeak & Seas

[57] ABSTRACT

A voice coil bobbin construction for a planar diaphragm loudspeaker including plural bobbin frames joined together to form the composite voice coil bobbin. In one embodiment, the bobbin frames each have a coupling member at each end thereof which are bonded together in a planar contact. Reinforcing ribs may be provided extending parallel to the planar diaphragm. In another embodiment, a mounting flange intimately bonded to the planar diaphragm and a voice coil flange upon which the voice coil is mounted are provided. A damper fastening portion can also be formed by leaving a portion free of through-holes in the bobbin frames. The feeder wires to the voice coil can be run through the through-holes in the bobbin frames.

9 Claims, 13 Drawing Figures

VOICE COIL BOBBIN FOR PLANAR DIAPHRAGM

BACKGROUND OF THE INVENTION

The present invention relates to voice coil bobbins for planar diaphragms in planar diaphragm loudspeakers. More particularly, the invention relates to a regular polygonal voice coil bobbin for a corresponding regular polygonal planar diaphragm.

The invention relates to voice coil bobbins for planar diaphragms and more particularly to a voice coil bobbin for a planar diaphragms the weight of which is reduced.

It is known that a planar diaphragm has a relatively flat acoustic pressure characteristic throughout its frequency range thus providing high fidelity sound reproduction. Accordingly, loudspeaker systems employing planar diaphragms have been proposed in the art.

For a collective drive type loudspeaker system using such a planar diaphragm, it is necessary to provide a driver unit capable of subjecting the entire area of the planar diaphragm uniformly to piston motion. Especially, the configuration of a voice coil bobbin coupled directly to the planar diaphragm is of utmost importance. It is desirable that a voice coil bobbin for a regular polygonal planar diaphragm be a corresponding regular polygonal voice coil bobbin having sides arranged parallel to the sides of the regular polygonal planar diaphragm.

A regular polygonal voice coil bobbin, especially a square voice coil bobbin, has a low rigidity at its corners. Accordingly, a square voice coil bobbin cannot be maintained square. That is, the square configuration of the square voice coil bobbin is deformed into a parallelepiped configuration which makes it impossible to uniformly drive the entire area of the diaphragm. In addition, the voice coil bobbin itself should have a considerably high rigidity in order to be able to satisfactorily transmit the driving force generated in the voice coil to the planar diaphragm against the weight of the planar diaphragm.

If the adhesion between a planar diaphragm and its voice coil bobbin is inadequate, then the driving force produced by the voice coil bobbin is not sufficiently transmitted to the diaphragm. Thus, the voice coil bobbin must be positively bonded to the diaphragm. In loudspeakers of this general type, a metal planar diaphragm using a honeycomb core is employed because it is required that the planar diaphragm be light in weight, have a high rigidity and be partially undeformable. Thus, planar diaphragms have been designed to reduce their weight using various techniques. However, the weights of planar diaphragms known to date are still high. In addition to this, the voice coil bobbin coupled to the diaphragm is also relatively heavy. This is undesirable because some of the driving force generated in the voice coil is wasted or ineffectively used.

Planar diaphragm type loudspeaker systems in which bass-range, mid-range and treble-range loudspeakers are mounted on a baffle board are known in the art. One of the advantages of such a planar diaphragm type loudspeaker system is that its acoustic image has very little shift. If a two-way or three-way loudspeaker system mounted on a baffle board is replaced by a corresponding coaxial loudspeaker system, then the amount of shift of the acoustic image is further reduced.

For this purpose, it is desirable to construct a coaxial loudspeaker system in which planar diaphragms are arranged coaxially. However, the assembly of the coaxial loudspeaker system involves problems which do not arise in the construction of ordinary cone type loudspeakers. Specifically, it is rather difficult to connect the voice coils to the feeder wires. That is, although the voice coil of the bass-range diaphragm is positioned near the outermost peripheral portion of the loudspeaker, the voice coils of the mid-range and treble-range diaphragms are positioned near the center of the loudspeaker and therefore it is difficult to introduce the feeder wires into the central portion of the loudspeaker and to lead them out of the central portion.

SUMMARY OF THE INVENTION

An object of the invention is to provide a voice coil bobbin which causes the entire area of a regular polygonal planar diaphragm coupled thereto to provide a desired piston motion.

Another object of the invention is to increase the rigidity of each of the corners of the voice coil bobbin.

Yet further, an object of the invention is to provide a voice coil bobbin which can satisfactorily transmit the driving force to the planar diaphragm and which consequently improves the efficiency of assembly of a loudspeaker system.

A further object of the invention is to improve the adhesion between a voice coil bobbin and the planar diaphragm as well as the adhesion between the voice coil bobbin and the voice coil.

A yet further object of the invention is to provide a voice coil bobbin of reduced weight thereby to provide a loudspeaker system having relatively light movable parts.

To accomplish these and other objects, according to the invention, the voice coil bobbin is formed by assembling bobbin frames corresponding to the sides of the voice coil bobbin. More specifically, two coupling members are provided at both ends of each bobbin frame so that the coupling members of adjacent bobbin frames are brought into intimate contact with each other. The coupling members are bonded together with adhesive to assemble the bobbin frames thereby to provide the voice coil bobbin with a high rigidity.

A further specific feature of a voice coil bobbin constructed according to the invention resides in that a reinforcing rib is provided extending from each of the members which form the voice coil bobbin thereby reinforcing the bobbin.

Other objects of the invention have also been achieved by the provision of a voice coil bobbin which includes mounting flange means extending from one end of the voice coil bobbin so as to be capable of being intimately bonded to a planar diaphragm and voice coil flange means extending from the opposite end of the voice coil bobbin to provide a mounting for a voice coil thereon. The mounting flange means is fixedly bonded to the planar diaphragm with adhesive as is the voice coil flange means to the voice coil.

Another specific feature of the invention is that a number of through-holes are formed in bobbin frames forming the voice coil bobbins to reduce their weight but no through-holes are formed in the portion of the voice coil bobbin to which a damper is fastened.

According to another aspect of the invention, the feeder wires to the voice coil of the speaker are passed through through-holes which are formed in the voice coil bobbin in order to reduce its weight. A specific feature of the invention resides in that this technical concept is applied to all types of voice coils which are mounted on a voice coil bobbin having such through-holes.

DESCRIPTION OF THE PREFERRED EMBODIMENTS

The invention will be described with reference to the accompanying drawings.

Figure 1:
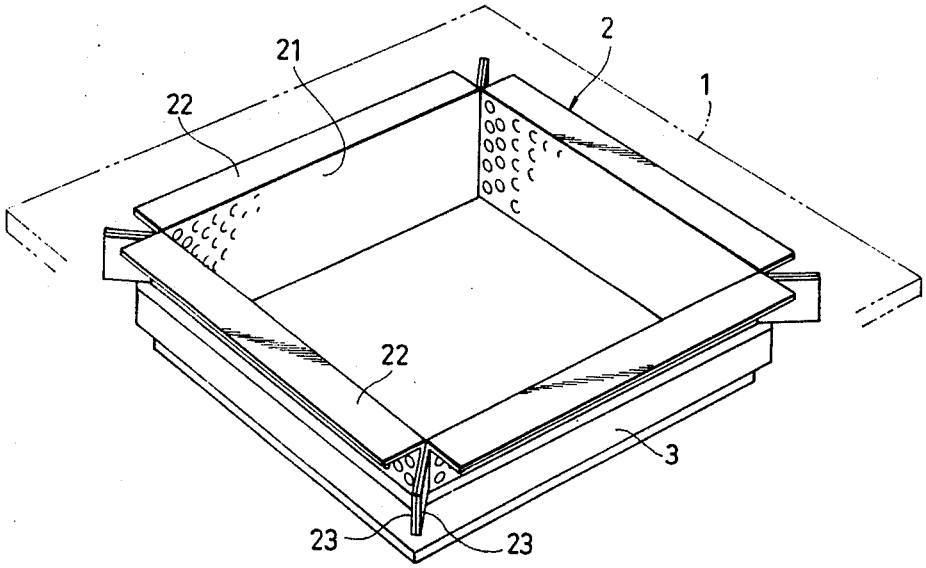
FIG. 1 is a perspective view showing a first embodiment of a voice coil bobbin for a planar diaphragm according to the invention.
Figure 2:
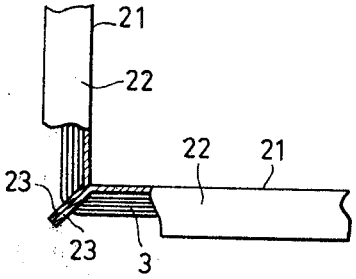
FIG. 2 is a plan view, at enlarged scale, showing a part of the voice coil bobbin of FIG. 1.
Figure 3:
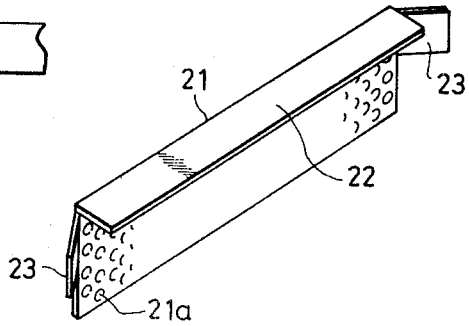
FIG. 3 is a perspective view of one of the bobbin frames which form the voice coil bobbin of FIG. 1.

Referring first to FIGS. 1–3, a square diaphragm 1 is formed by applying a skin material to a honey-comb core. A rectangular voice coil bobbin 2 is bonded to one surface of the diaphragm 1. The voice coil bobbin 2 is formed by assembling bobbin frames 21 with each of the frames 21 arranged parallel to one of the four edges of the square diaphragm 1. Each of the bobbin frames 21 has a number of minute holes 21*a* in order to reduce its weight. The upper portion of the bobbin frame 21 is bent at right angles outwardly to form a flange 22. The flange 22 provides a sufficient contact area with the diaphragm 1 and reinforces the bobbin frame 21 itself. Both end portions of each bobbin frame 21 are bent outwardly at angles 45° with the longitudinal direction of the bobbin frame 21 to provide coupling members 23. However, it should be noted that the coupling members 23 do not extend to the lower edge of the bobbin frame 21. The coupling members 23 of the bobbin frames 21 are bonded together to form the voice coil bobbin 2. A voice coil 3 is wound around the portion of the voice coil bobbin 2 where the coupling members 23 are not formed.

The construction of the voice coil bobbin is as described above. In other words, the coupling members 23 are provided at both ends of each of the bobbin frames 21 forming the voice coil bobbin 2 in such a manner that the coupling members 23 of adjacent bobbin frames 21 are in planar contact with each other. The coupling members 23 are bonded together with adhesive to increase the strength of the corners of the voice coil bobbin 2.

The invention has been described with reference to a square voice coil bobbin the coupling members of which form angles of 45° with the respect to the bobbin frames. However, it should be noted that the invention is not limited thereto or thereby. The coupling member extending angle is determined by the number of sides of a voice coil bobbin. If it is intended to provide a regular polygonal voice coil bobbin having N sides, then the coupling member extending angle is 360°/2 N.

As is apparent from the above description, in a voice coil bobbin for a planar diaphragm according to the invention, the several members of bobbin frames are easily assembled to form the voice coil bobbin and therefore the assembly of the voice coil bobbin can be readily achieved. In addition, each bobbin frame has coupling members at both ends so that adjacent bobbin frames are coupled through intimate contact between the coupling members. In the voice coil bobbin thus assembled, the bobbin frames are rigidly bonded together. Accordingly, the voice coil bobbin has a considerably high rigidity and accordingly is therefore relatively undeformable.

A second embodiment of the invention will be described with reference to FIGS. 4–6.

Figure 4:
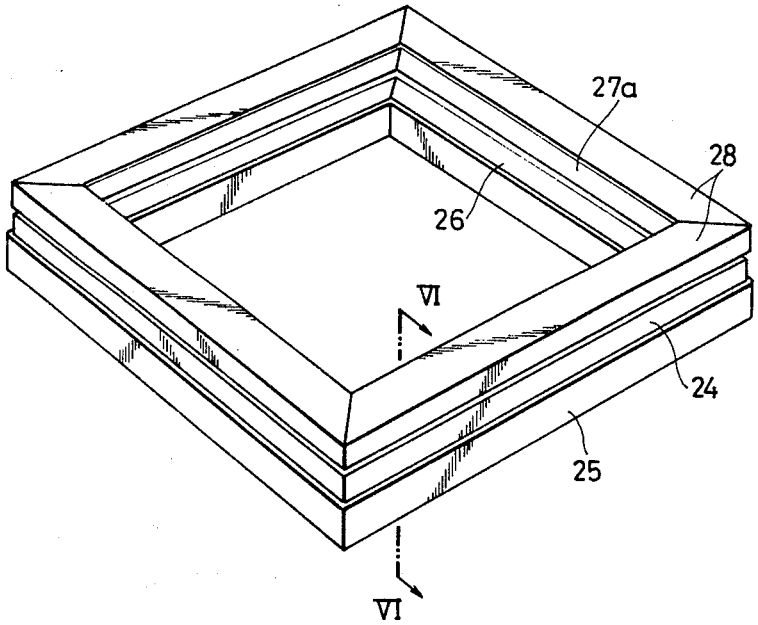
FIG. 4 is a perspective view of a second embodiment of a voice coil bobbin of the invention.
Figure 5:
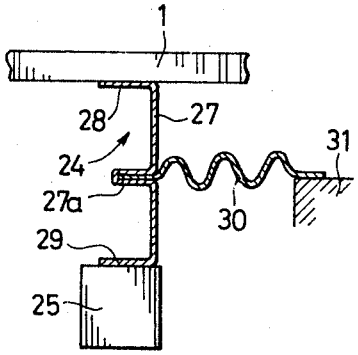
FIG. 5 is an enlarged sectional view taken along line VI—VI in FIG. 4.
Figure 6:
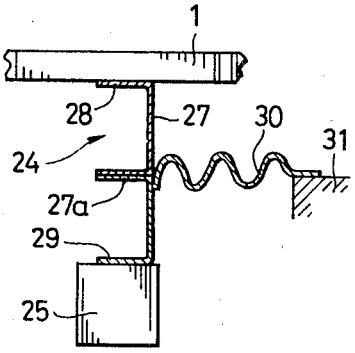
FIG. 6 is also an enlarged sectional view similar to that in FIG. 5 showing an alternative construction to that shown in FIG. 5.

Referring to FIGS. 4–6, a planar diaphragm 1 is formed by bonding a skin material to a honeycomb core. The planar diaphragm 1 is square. A square voice coil bobbin 24 is secured to the central portion of the square diaphragm 1 with the sides of the voice coil bobbin 24 parallel to the sides of the square diaphragm 1. The bobbin 24 is formed by assembling four bobbin frames 27 corresponding to the four sides of the coil bobbin 24 connected at their corners. Each of the bobbin frames 27 has a mounting flange 28, which is provided by bending the upper end portion of each bobbin frame at a right angle along its longitudinal direction, and a voice coil flange 29 which is provided also by bending the lower end portion of each bobbin frame at a right angle along its longitudinal direction. It should be noted that the flanges 28 and 29 face inwardly when the bobbin frames 27 are assembled. A voice coil 25 which was formed in advance is bonded to the voice coil flange with adhesive.

Each of the bobbin frames 27 forming the voice coil bobbin 24 has a rib 27*a* which extends longitudinally and in the same direction as the flanges. More specifically, each rib 27*a* is formed by folding the central portion of the bobbin frame 27 into a deep U-shaped groove which extends longitudinally. One edge portion of a damper 30, which has been coated with adhesive, is inserted into the U-shaped groove and is secured therein while the other edge portion of the damper 30 is secured to a frame 31.

In the bobbin frame as shown in FIG. 5, the rib 27*a* is formed as a U-shaped groove which is a portion of the bobbin frame 27 which is made of a single material. Another example of the bobbin frame of the invention, as shown in FIG. 6 is made up of two members each having a U-shaped cross section. The two members are stacked one on another to form the bobbin frame and the rib 27*a*. In this example, one edge portion of a damper 30 is bonded to the side of the bobbin frame 27*a*.

In the voice coil bobbin thus constructed, a driving force generated in the voice coil is transmitted through the voice coil bobbin 24 to the diaphragm 1. In this operation, the bobbin frames 27 forming the voice coil bobbin 24 are subjected to forces such as tension and compression. However, the driving force is positively transmitted to the diaphragm because the voice coil bobbin 24 is reinforced by the ribs 27*a* against deformation.

The flanges and the ribs may extend either inwardly or outwardly so long as the flanges and ribs do not disturb the movement of the damper. However, in the case where one edge portion of the damper is held by the ribs as in the example shown in FIG. 5, the ribs must extend inwardly of the voice coil bobbin.

As is clear from the above description, in a voice coil bobbin for a planar diaphragm according to this embodiment, the ribs are formed on the bobbin frames forming the voice coil bobbin with the ribs extending longitudinally of the respective bobbin frames forming 90° angle with the frames. Therefore, the voice coil bobbin will not deform and, accordingly, it can positively transmit the driving force to the diaphragm.

Figure 7:
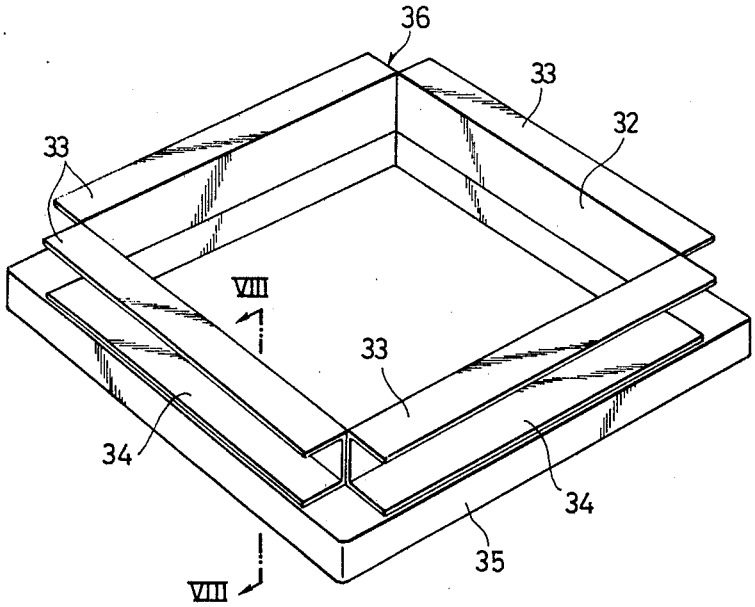
FIG. 7 is a perspective view of a voice coil bobbin for a planar diaphragm according to another embodiment of the invention.
Figure 8:
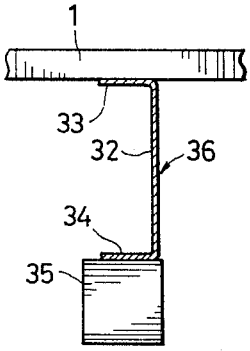
FIG. 8 is a sectional view, at an enlarged scale, taken along line VIII—VIII in FIG. 7.

A yet further embodiment of the invention will be described with reference to FIGS. 7 and 8. In FIGS. 7 and 8, reference numeral 1 designates a planar diaphragm as in the previously described embodiments. A voice coil bobbin 36 according to the invention is secured to the central portion of the square diaphragm 1 in such a manner that the sides of the bobbin 36 are parallel to the sides of the square diaphragm 1.

The voice coil bobbin 36 is formed by assembling individual bobbin frames 32 corresponding to the sides of the bobbin 36. More specifically, the bobbin frames 32 are connected at the ends or corners of the voice coil bobbin to form the voice coil bobbin. Each of the bobbin frames 36 is U-shaped in cross section and has a mounting flange 33 which is formed by bending the upper end portion of the bobbin frame 32 at a right angle and along the longitudinal axis of the bobbin frame 32 and a voice coil flange 34 which is formed also by bending the lower end portion of the bobbin frame 32 at a right angle along the longitudinal axis of the bobbin frame 32. In other words, the flanges 33 and 34 are formed by bending the upper and lower end edge portions of the bobbin frame 32 so that they face outwardly of the voice coil bobbin when the bobbin is assembled.

A voice coil 35, which was formed in advance, is secured to the voice coil flanges 34 of the voice coil bobbin 36 with adhesive. The mounting flanges 33 are coated with adhesive and are then bonded to the planar diaphragm 1 with planar contact therebetween. Accordingly, the flanges 33 and the diaphragm 1 are rigidly and positively coupled to form a single unit. The voice coil 35 is bonded to the surfaces of the voice coil flange as a result of which the voice coil 35, the bobbin 36 and the diaphragm 1 form a rigidly coupled unit.

The voice coil bobbin 36 is formed by assembling four bobbin frames 32 which make up the sides of the bobbin 36. However, it should be noted that the invention is not limited thereto or thereby. That is, the voice coil bobbin may be formed by connecting two bobbin frame members each of which is in the form of two bobbin frames connected together for two sides of the bobbin or by connecting the two ends of a bobbin frame member which is in the form of four series-connected bobbin frames. In FIGS. 7 and 8, the flanges 33 and 34 extend outwardly. However, they may extend inwardly if desired.

As is apparent from the above description, the voice coil bobbin according to the invention has mounting flanges to which the planar diaphragm is bonded so that the bobbin can be firmly and positively attached to the planar diaphragm. The voice coil bobbin further is provided with a voice coil flange to which the voice coil is secured and therefore the voice coil can be readily mounted on the voice coil bobbin. The voice coil bobbin is reinforced by the flanges against deformations such as bending. That is, the provision of the flanges is quite effective in preventing deformation of the voice coil bobbin.

Another embodiment of the invention will be described with reference to FIGS. 9 and 10.

Figure 9:
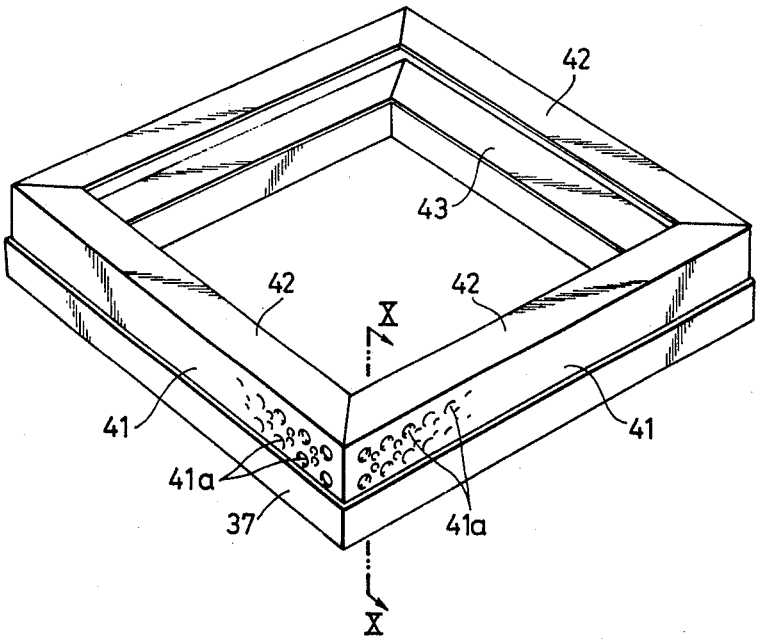
FIG. 9 is a perspective view of a voice coil bobbin according to yet another embodiment of the invention.
Figure 10:
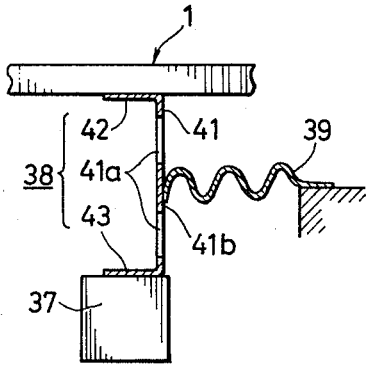
FIG. 10 is a sectional view, at an enlarged scale, taken along the line X—X in FIG. 9.

In FIGS. 9 and 10, reference numeral 1 designates a planar diaphragm which is formed by bonding a skin material such as mica or carbon film to a honeycomb core of aluminum. The voice coil bobbin 38 according to the invention is secured to the central portion of the diaphragm in such a manner that the sides of the voice coil bobbin 38 are parallel to the sides of the planar diaphragm. The voice coil bobbin 38 is formed by connecting individual bobbin frames 41 corresponding to the sides of the voice coil bobbin 38. The upper end portion of each of the bobbin frames 41 is bent to provide a mounting flange 42 which is placed in planar contact with the planar diaphragm 1 and the lower end portion is bent to provide a voice coil flange 43 to which is bonded a voice coil 37. Thus, each bobbin frame 41 has an upper end portion, a lower end portion and a central portion extending longitudinally between the upper and lower end portions.

Each bobbin frame 41 has a number of through-holes 41*a* arranged regularly to reduce the weight of the frame with the weight distribution of the entire voice coil bobbin made uniform. However, it should be noted that no through-holes 21*a* are formed along a center line extending longitudinally of the central portion. This region is used to attach a fastening portion 41*b* of a damper 39.

The voice coil bobbin 38 according to this embodiment of the invention is constructed as described above. The weight of each of the bobbin frames 41 forming the voice coil bobbin 38 is reduced and accordingly the total weight of the voice coil bobbin 38 is also reduced. The damper fastening portion 41*b* is attached to the central portion of each bobbin frame 41 where no through-holes 21*a* are formed so that one end of the damper 39 can be bonded thereto with a sufficiently large bonding area. Thus, the damper is sufficiently supported by the voice coil bobbin. The upper and lower end portions of each bobbin frame may be bent either inwardly or outwardly of the voice coil bobbin.

As is clear from the above description, in a voice coil bobbin according to this embodiment of the invention, through-holes are formed in the bobbin frames forming the voice coil bobbin to reduce the weight of the voice coil bobbin and to establish a uniform weight distribution in the voice coil bobbin while a damper fastening portion with no through-holes formed therein is provided to attach one end of the damper. Therefore, even with the reduced weight of the voice coil bobbin, the damper is positively supported by the voice coil bobbin.

Figure 12:
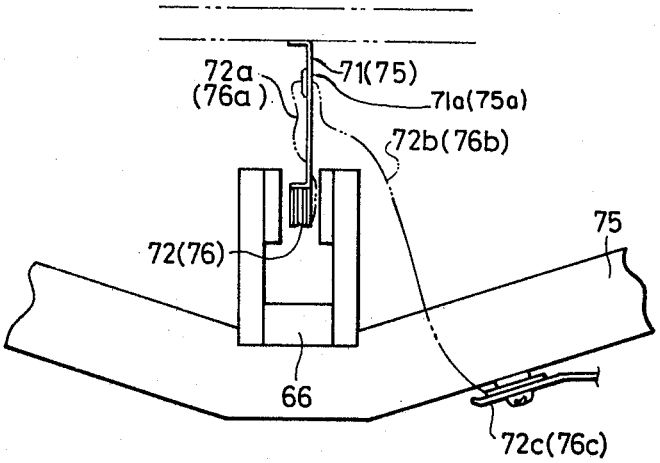
FIG. 12 is a sectional view, at an enlarged scale, showing a part XII in FIG. 11.
Figure 13:
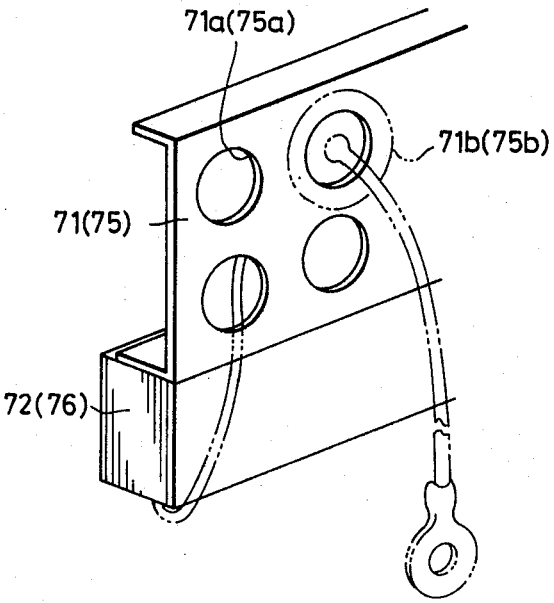
FIG. 13 is a perspective view showing the part XII in FIG. 11.

A coaxial speaker of the invention will be described with reference to FIGS. 11–13.

Figure 11:
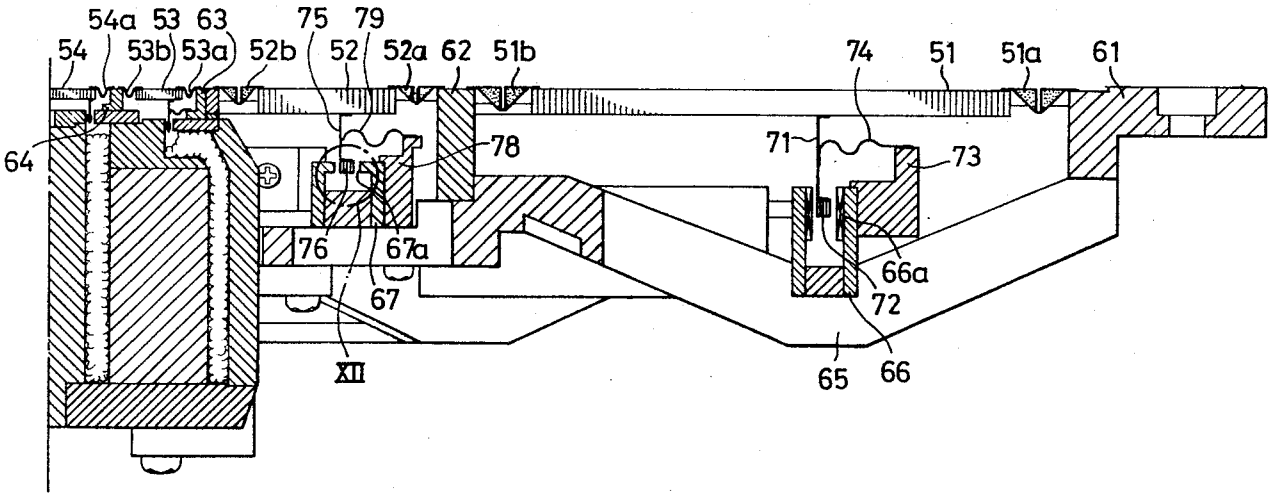
FIG. 11 is a sectional view of a planar diaphragm type loudspeaker system according to the invention.

Referring to FIG. 11, a planar diaphragm assembly which is formed by bonding a skin material to a honeycomb core of aluminum is shown. The planar diaphragm assembly is made up of an outermost diaphragm or bass-range diaphragm 51, a mid-range diaphragm 52, a treble-range diaphragm 53, and an innermost diaphragm or super-treble-range diaphragm 54 which are arranged in the stated order. The outer edge of the bass-range diaphragm 51 is attached through an edge member 51*a* to the outermost frame 61, which is a part of an overall rigid frame assembly, and with the inner edge supported through an edge member 51*b* by an inner circumferential frame 62. The outer edge of the mid-range diaphragm 52 is coupled through an edge member 52*a* to the inner frame 62 and the inner edge is secured through an edge member 52*b* to a second inner frame 63. The treble-range diaphragm 53 is supported through edge members 53*a* and 53*b* by the second inner frame 63 and a center frame 64, respectively. The super-treble-range diaphragm 54 is supported through an edge member 54*a* by the center frame 64.

A coupling frame 65 coupling the outermost circumferential frame 61 to the inner frame 62 is provided behind the bass-range diaphragm 51. A magnetic circuit member 66 is mounted on the coupling frame 65. A voice coil 72 wrapped around the voice coil bobbin 71 of the bass-range diaphragm 51 is positioned in an air gap 66*a* formed by the magnetic circuit member 66. The magnetic circuit member 66 has a damper support 73 which supports the voice coil bobbin 71 through a damper 74 thus forming a suspension mechanism.

Similar to the bass-range diaphragm, for the mid-range diaphragm, a voice coil 76 wound around a voice coil bobbin 75 is disposed in the air gap 67*a* of a magnetic circuit member 67 which is mounted on a member forming the overall frame. The magnetic circuit member 67 is provided with a damper support 78 forming a suspension mechanism. One end of a damper 79 is secured to the damper support 78 while the other end supports the voice coil bobbin 75.

The feeder wires 72*a* and 76*a* of the voice coils 72 and 76 are passed through ones of the through-holes 71*a* and 75*a* which are formed in a regular pattern in the voice coil bobbins 71 and 75, respectively. Then, the feeder wires 72*a* and 76*a* are connected to lead wires 72*b* and 76*b* at bushings 71*b* and 75*b*, respectively, mounted in different through-holes.

The lead wires 72*b* and 76*b* are coupled through terminals 72*c* and 76*c* provided on the frame forming members such as for instance the coupling frame 65 resulting in a reduction of the actual lengths of the lead wires and thereby preventing the occurrence of a so-called "contact" and "resonance" phenomena.

In the planar diaphragm type loudspeaker system according to the invention, the feeder wires for the voice coils are passed through the through-holes 71*a* and 75*a* of the voice coil bobbins 71 and 75, respectively, so no excessive extension of the feeder wires is necessary.

As is apparent from the above description, in a planar diaphragm type loudspeaker system of the invention, the voice coil bobbins have through-holes arranged in a regular pattern to reduce the weights thereof and the feeder wires for the voice coils are passed through the through-holes and connected to the feeders.

What is claimed is:

1. A regular polygonal voice coil bobbin for a corresponding regular polygonal planar diaphragm in which one edge of said voice coil bobbin is secured to said planar diaphragm comprising: a plurality of bobbin frames forming said regular polygonal voice coil bobbin, each of said bobbin frames having a coupling member at each end thereof each of which extends outwardly forming a predetermined angle with the longitudinal direction of the respective bobbin frame with said coupling members of adjacent bobbin frames being in planar contact with one another, said coupling members being bonded together to assemble said bobbin frames into said voice coil bobbin.

2. The voice coil bobbin of claim 1 wherein each of said bobbin frames comprises a mounting flange extending from an upper side of said voice coil bobbin so as to be intimately bonded to said planar diaphragm and a voice coil flange extending from the opposite end of each of said bobbin frames to provide means for mounting a voice coil thereon.

3. The voice coil bobbin of claim 1 wherein each of said bobbin frames is provided with at least one reinforcing rib extending parallel to said planar diaphragm.

4. The voice coil bobbin of claim 3 wherein said reinforcing rib is provided by bending said bobbin frame in a U-shape.

5. The voice coil bobbin of claim 3 wherein each of said bobbin frames is divided into two sections which are joined along flanges extending parallel to said planar diaphragm.

6. The voice coil bobbin of claim 1 wherein a regular pattern of holes is formed in each of said bobbin frames.

7. The voice coil bobbin of claim 6 wherein no holes are provided along a center portion of each of said bobbin frames for forming a damper fastening portion and further comprising a damper fastened at one end to said damper fastening portion.

8. The voice coil bobbin of any one of claims 4–7 further comprising at least one feeder wire coupled to a voice coil, said feeder wire running through at least a predetermined one of said holes in said bobbin frames.

9. A voice coil bobbin for a planar diaphragm wherein one end of said voice coil bobbin is secured to said planar diaphragm comprising mounting flange means extending from one end of said voice coil bobbin so as to be intimately bonded to said planar diaphragm, and voice coil flange means extending from the opposite end of said voice coil bobbin so as to provide for mounting a voice coil thereon.

* * * * *